US010795306B2

(12) United States Patent
Nakane et al.

(10) Patent No.: US 10,795,306 B2
(45) Date of Patent: Oct. 6, 2020

(54) CLEANING MEMBER FOR IMAGE FORMING APPARATUS INCLUDING A PROTRUSION

(71) Applicant: Konica Minolta, Inc., Tokyo (JP)

(72) Inventors: Yoshiki Nakane, Hachioji (JP); Takenobu Kimura, Hachioji (JP); Kei Okamura, Yokohama (JP); Hiroshi Morimoto, Akiruno (JP); Natsuko Minegishi, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/654,795

(22) Filed: Oct. 16, 2019

(65) Prior Publication Data

US 2020/0125026 A1 Apr. 23, 2020

(30) Foreign Application Priority Data

Oct. 23, 2018 (JP) ..... 2018-199248

(51) Int. Cl.
*G03G 21/00* (2006.01)

(52) U.S. Cl.
CPC ..... *G03G 21/0011* (2013.01)

(58) Field of Classification Search
CPC ..... G03G 21/0011
See application file for complete search history.

(56) References Cited

U.S. PATENT DOCUMENTS

2011/0206411 A1* 8/2011 Mizushima ..... G03G 21/0011 399/111
2017/0168448 A1* 6/2017 Hagimoto ..... G03G 21/0011
2017/0285553 A1* 10/2017 Tano ..... G03G 21/0011
2018/0356752 A1* 12/2018 Kawanago ..... G03G 15/161

FOREIGN PATENT DOCUMENTS

JP 2004-245881 A 9/2004

* cited by examiner

*Primary Examiner* — Sophia S Chen
(74) *Attorney, Agent, or Firm* — Squire Patton Boggs (US) LLP

(57) ABSTRACT

An image forming apparatus includes a cleaning member formed by an elastic body, and a member to be cleaned in which toner added with an external additive adheres to a surface, and the toner is to be cleaned by the cleaning member being in contact with the surface, wherein the cleaning member has a protrusion disposed on a cleaning surface extending from a contact part with the member to be cleaned, and facing a side where the toner is to be cleaned, of the member to be cleaned.

10 Claims, 7 Drawing Sheets

CLEANING MEMBER FOR IMAGE FORMING APPARATUS INCLUDING A PROTRUSION

The entire disclosure of Japanese patent Application No. 2018-199248, filed on Oct. 23, 2018, is incorporated herein by reference in its entirety.

BACKGROUND

Technological Field

The present invention relates to an image forming apparatus.

Description of the Related Art

Generally, image forming apparatuses (printers, copiers, facsimiles, and the like) using electrophotographic process technology form an electrostatic latent image by irradiating (exposing) a charged photosensitive drum (image carrier) with laser light based on image data. Then, by supplying toner from a developing device to the photosensitive drum formed with the electrostatic latent image, the electrostatic latent image is visualized to form a toner image. Furthermore, after being transferred directly or indirectly to a sheet, this toner image is heated and pressed by a fixing nip to be fixed, whereby a toner image is formed on the sheet.

There is known a configuration in which toner remaining on an image carrier without being transferred onto a sheet is scraped off and cleaned by a plate-shaped cleaning member. The cleaning member is in contact with a member to be cleaned (image carrier), and scrapes off toner on the member to be cleaned, by the member to be cleaned being driven.

To the toner, an external additive is added. The external additive is separated from the toner when convective toner collides with one another near a contact part between the cleaning member and the member to be cleaned, and the external additive enters between the cleaning member and the member to be cleaned. This causes the external additive to serve as a roller to suppress direct contact between the cleaning member and the member to be cleaned.

When the cleaning member is contacted to clean the member to be cleaned, the contact part of the cleaning member is worn out to cause deterioration of a cleaning function, resulting in a cleaning failure. However, the external additive entering between the cleaning member and the member to be cleaned enables suppression of wear of the cleaning member. This can reduce downtime due to parts maintenance in the image forming apparatus.

Further, JP 2004-245881 A discloses a configuration in which a plurality of recesses are provided on a surface of a cleaning member facing toward a member to be cleaned. In this technique, by holding toner in the recess, the toner is inhibited from slipping between the cleaning member and the member to be cleaned.

However, when toner cleaned at a contact part between the cleaning member and the member to be cleaned collides with the cleaning member, the toner is repelled toward the member to be cleaned. When the repelled toner collides with convective toner near the contact part, the toner tends to aggregate on a surface of the cleaning member near the contact part. As toner aggregation on the surface increases, a space near the contact part is narrowed, which causes a convection range of the toner near the contact part to be limited to the space.

Therefore, when an amount of convective toner in the space decreases, it becomes difficult for the external additive to be separated from the toner in the space. That consequently reduces the external additive entering between the cleaning member and the member to be cleaned, causing a risk that the cleaning member is likely to be worn.

SUMMARY

An object of the present invention is to provide an image forming apparatus capable of suppressing wear of a cleaning member.

To achieve the abovementioned object, according to an aspect of the present invention, an image forming apparatus reflecting one aspect of the present invention comprises a cleaning member formed by an elastic body, and a member to be cleaned in which toner added with an external additive adheres to a surface, and the toner is to be cleaned by the cleaning member being in contact with the surface, wherein the cleaning member has a protrusion disposed on a cleaning surface extending from a contact part with the member to be cleaned, and facing a side where the toner is to be cleaned, of the member to be cleaned.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
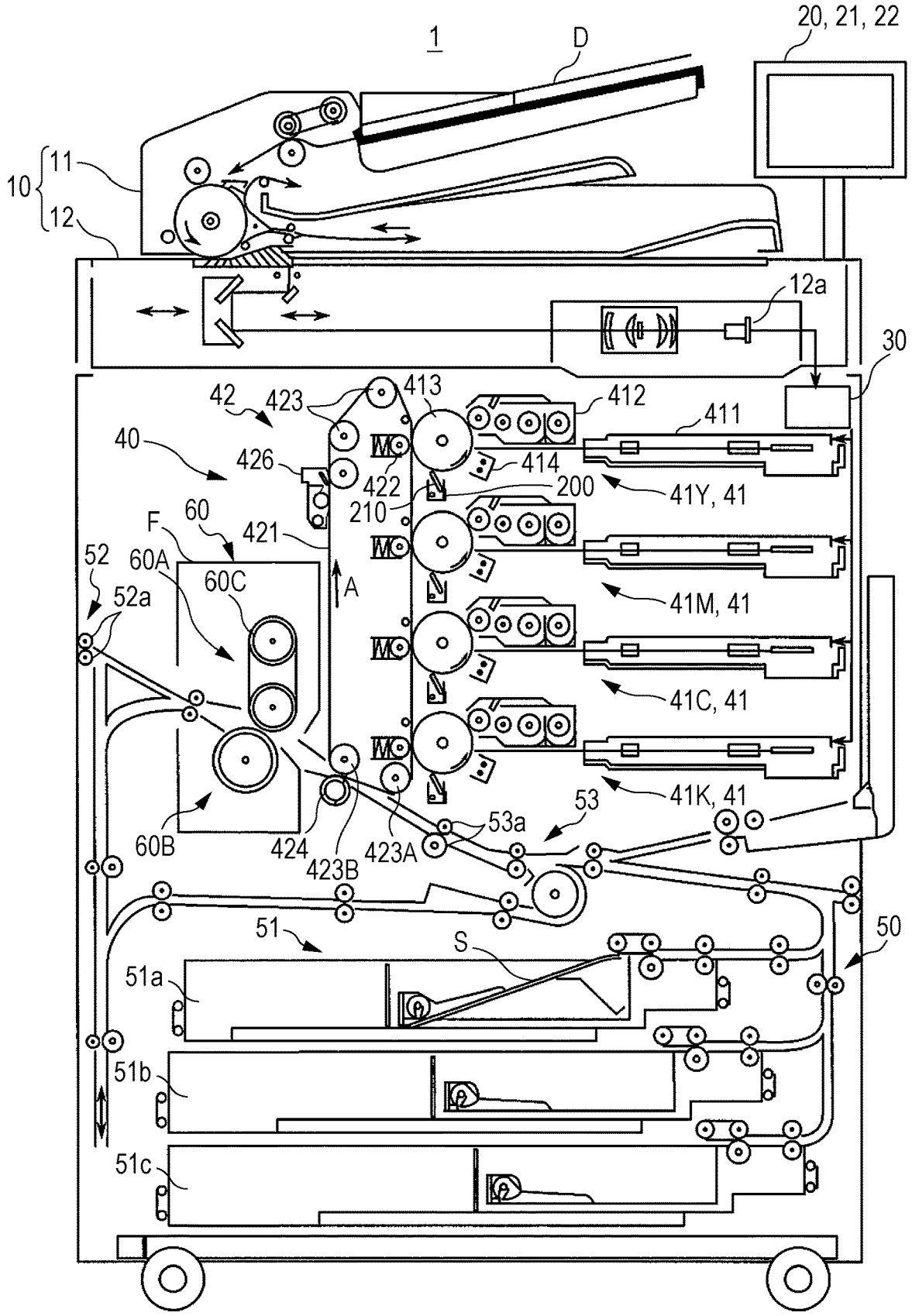
FIG. 1 is a view schematically showing an entire configuration of an image forming apparatus according to an embodiment of the present invention.
Figure 2:
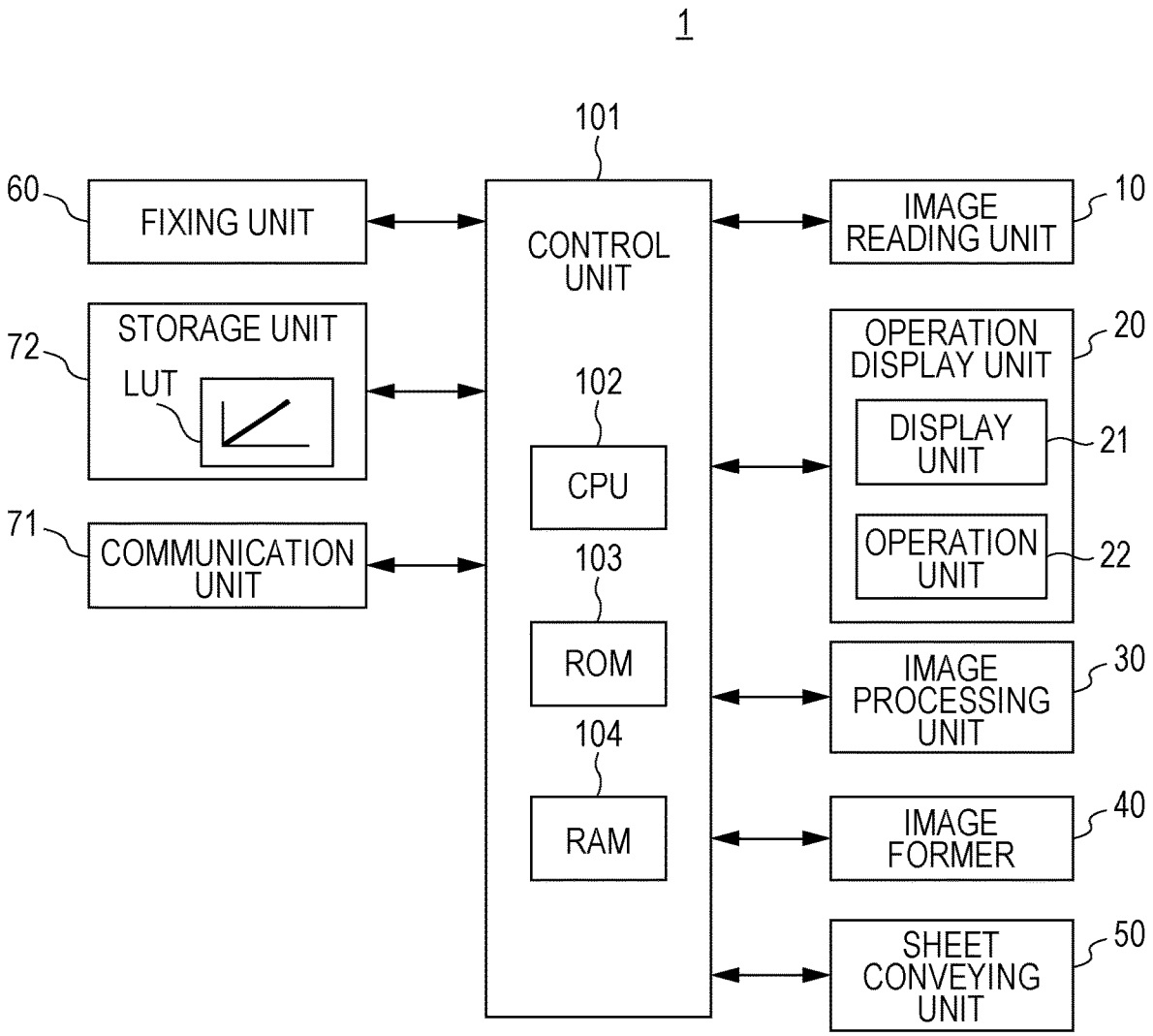
FIG. 2 is a view showing a main part of a control system of the image forming apparatus.

Hereinafter, one or more embodiments of the present invention will be described with reference to the drawings. However, the scope of the invention is not limited to the disclosed embodiments. FIG. 1 is a view schematically showing an entire configuration of an image forming apparatus 1 according to an embodiment of the present invention. FIG. 2 is a view showing a main part of a control system of the image forming apparatus 1.

The image forming apparatus 1 shown in FIGS. 1 and 2 is an intermediate-transfer color image forming apparatus using an electrophotographic process technology. That is, the image forming apparatus 1 primarily transfers respective color toner images of yellow (Y), magenta (M), cyan (C), and black (K) formed on a photosensitive drum 413 to an intermediate transfer belt 421, superimposes the four color toner images on the intermediate transfer belt 421, and then secondary transfers the toner images onto a sheet S, to form an image.

Further, to the image forming apparatus 1, a tandem method is employed in which the photosensitive drums 413 corresponding to the four colors of YMCK are arranged in series in a traveling direction of the intermediate transfer belt 421, and toner images of the respective colors are sequentially transferred to the intermediate transfer belt 421 in a single procedure.

As shown in FIG. 2, the image forming apparatus 1 includes an image reading unit 10, an operation display unit 20, an image processing unit 30 as an example of an image processing device, an image former 40, a sleet conveying unit 50, a fixing unit 60, and a control unit 101.

The control unit 101 includes a central processing unit (CPU) 102, a read only memory (ROM) 103, a random access memory (RAM) 104, and the like. The CPU 102 reads a program according to processing contents from the ROM 103, develops the program in the RAM 104, and cooperates with the developed program to control an operation of each block of the image forming apparatus 1. At this time, various data stored in a storage unit 72 are referred to. The storage unit 72 is formed by, for example, a non-volatile semiconductor memory (so-called flash memory) or a hard disk drive.

The control unit 101 exchanges various data with an external device (for example, a personal computer) connected to a communication network such as a local area network (LAN) or a wide area network (WAN), via a communication unit 71. For example, the control unit 101 receives image data transmitted from the external device, and forms an image on the sheet S on the basis of the image data (input image data). The communication unit 71 is formed by, for example, a communication control card such as a LAN card.

As shown in FIG. 1, the image reading unit 10 includes an automatic document feeding device 11 called an auto document feeder (ADF), a document image scanning device 12 (scanner), and the like.

The automatic document feeding device 11 conveys a document D placed on a document tray by a conveyance mechanism, and sends the document D to the document image scanning device 12. The automatic document feeding device 11 enables continuous reading of images (including both sides) at once of a large number of the documents D placed on the document tray.

The document image scanning device 12 optically scans a document conveyed onto a contact glass from the automatic document feeding device 11 or a document placed on the contact glass, and forms an image of reflected light from the document onto a light receiving surface of a charge coupled device (CCD) sensor 12*a*, to read the document image. The image reading unit 10 generates input image data based on a reading result of the document image scanning device 12. The image processing unit 30 applies predetermined image processing to the input image data.

As shown in FIG. 2, the operation display unit 20 is formed by, for example, a liquid crystal display (LCD) with a touch panel, and functions as a display unit 21 and an operation unit 22. The display unit 21 displays various operation screens, a state of an image, an operation status of each function, and the like in accordance with a display control signal inputted from the control unit 101. The operation unit 22 includes various operation keys such as a ten key and a start key, receives various input operations by a user, and outputs an operation signal to the control unit 101.

The image processing unit 30 includes a circuit or the like that performs digital image processing according to initial setting or user setting, on the input image data. For example, the image processing unit 30 performs gradation correction on the basis of gradation correction data (gradation correction table) under the control of the control unit 101. Further, the image processing unit 30 performs, on the input image data, various correction processes such as color correction and shading correction in addition to the gradation correction, compression processing, and the like. On the basis the image data subjected to these processes, the image former 40 is controlled.

As shown in FIG. 1, the image former 40 includes: image forming units 41Y. 41M, 41C, and 41K that form an image with respective color toners of a Y component, an M component, a C component, and a K component on the basis of input image data; an intermediate transfer unit 42; and the like.

The image forming units 41Y, 41M, 41C, and 41K for the Y component, the M component, the C component, and the K component have a similar configuration. For convenience of illustration and description, common constituents are denoted by the same reference numerals, and the individual constituents are indicated by adding Y, M, C or K to the reference numerals when being distinguished. In FIG. 1, reference numerals are given exclusively to the constituents of the image forming unit 41Y for the Y component, and reference numerals of the constituents of other image forming units 41M. 41C, and 41K are omitted.

The image forming unit 41 includes an exposure device 411, a developing device 412, the photosensitive drum 413, a charging device 414, a drum cleaning device 200, and the like.

The photosensitive drum 413 is made of, for example, an organic photoreceptor in which a photosensitive layer made of a resin containing an organic photoconductor is formed on an outer peripheral surface of a drum-shaped metal base.

The control unit 101 controls a drive current supplied to a drive motor (not shown) that rotates the photosensitive drum 413, to rotate the photosensitive drum 413 at a constant peripheral speed.

The charging device 414 is, for example, a scorotron and generates corona discharge to uniformly charge a surface of the photoconductive photosensitive drum 413 to a negative polarity.

The exposure device 411 is formed by, for example, a semiconductor laser, and irradiates the photosensitive drum 413 with a laser beam corresponding to an image of each color component. As a result, an electrostatic latent image of each color component is formed on an image region irradiated with the laser light on the surface of the photosensitive drum 413, due to a potential difference with a background region.

The developing device 412 is a two-component reverse rotation developing device, and visualizes the electrostatic latent image to form a toner image by causing developer of each color component to adhere to the surface of the photosensitive drum 413.

The developing device 412 is applied with, for example, a DC developing bias having the same polarity as a charging polarity of the charging device 414, or a developing bias in which a DC voltage having the same polarity as a charging polarity of the charging device 414 is superimposed on an AC voltage. As a result, reverse development is performed in which toner is made adhere to the electrostatic latent image formed by the exposure device 411.

The drum cleaning device 200 has a drum cleaning blade 210 and the like, and cleans the photosensitive drum 413 by removing toner remaining on the surface of the photosensitive drum 413 without being transferred to the intermediate transfer belt 421. The drum cleaning blade 210 corresponds to a "cleaning member" in the present invention. The photosensitive drum 413 corresponds to a "member to be cleaned" in the present invention. Details of the drum cleaning device 200 will be described later.

The intermediate transfer unit 42 includes the intermediate transfer belt 421, a primary transfer roller 422, a plurality of support rollers 423, a secondary transfer roller 424, a belt cleaning device 426, and the like.

The intermediate transfer unit 42 is formed by an endless belt, and is stretched around the plurality of support rollers 423 in a loop. At least one of the plurality of support rollers 423 is formed by a drive roller, and others are formed by a driven roller. For example, it is desirable that a roller 423A disposed downstream of the primary transfer roller 422 for the K component in a belt traveling direction is the drive roller. This makes it easy to keep a constant traveling speed of the belt in a primary transfer nip. As the drive roller 423A rotates, the intermediate transfer belt 421 travels at a constant speed in an arrow A direction.

The intermediate transfer belt 421 is a belt having conductivity and elasticity, and is rotationally driven by a control signal from the control unit 101.

The primary transfer roller 422 is disposed on an inner peripheral surface side of the intermediate transfer belt 421, so as to face the photosensitive drum 413 of each color component. By pressure contact of the primary transfer roller 422 and the photosensitive drum 413 with the intermediate transfer belt 421 interposed in between, the primary transfer nip for transfer of a toner image from the photosensitive drum 413 to the intermediate transfer belt 421 is formed.

The secondary transfer roller 424 is disposed on an outer peripheral surface side of the intermediate transfer belt 421, so as to face a backup roller 423B disposed on downstream of the drive roller 423A in the belt traveling direction. By pressure contact of the secondary transfer roller 424 and the backup roller 423B with the intermediate transfer belt 421 interposed in between, a secondary transfer nip for transfer of a toner image from the intermediate transfer belt 421 to the sheet S is formed.

When the intermediate transfer belt 421 passes through the primary transfer nip, the toner image on the photosensitive drum 413 is sequentially superimposed and primary transferred on the intermediate transfer belt 421. Specifically, by applying a primary transfer bias to the primary transfer roller 422, and supplying a charge of a polarity opposite to that of the toner to a back surface side of the intermediate transfer belt 421, that is, a side in contact with the primary transfer roller 422, the toner image is electrostatically transferred to the intermediate transfer belt 421.

Thereafter, when the sheet S passes through the secondary transfer nip, the toner image on the intermediate transfer belt 421 is secondarily transferred to the sheet S. Specifically, by applying a secondary transfer bias to the backup roller 423B, and supplying a charge of the same polarity as that of the toner to a front surface side of the sheet S, that is, a side in contact with the intermediate transfer belt 421, the toner image is electrostatically transferred to the sheet S, and the sheet S is conveyed toward the fixing unit 60.

The belt cleaning device 426 removes transfer residual toner remaining on a surface of the intermediate transfer belt 421 after the secondary transfer. Note that, instead of the secondary transfer roller 424, a so-called belt secondary transfer unit may be employed in which the secondary transfer belt is stretched in a loop around a plurality of support rollers including a secondary transfer roller.

The fixing unit 60 includes: an upper fixing unit 60A having a fixing-surface-side member disposed on a fixing surface side of the sheet S, that is, on a surface side formed with the toner image; a lower fixing unit 60B having a back-surface-side support member disposed on a back surface side of the sheet S, that is, on a side opposite to the fixing surface side; a heating source 60C; and the like. By pressure contact of the back-surface-side support member and the fixing-surface-side member, a fixing nip to hold and convey the sheet S is formed.

The fixing unit 60 fixes a toner image onto the sheet S by heating and pressurizing, with the fixing nip, the sheet S on which the toner image has been secondarily transferred and that has been conveyed. The fixing unit 60 is disposed as a unit in a fixing device F.

The sheet conveying unit 50 includes a sheet feeding unit 51, a sheet discharging unit 52, a conveyance path unit 53, and the like. In three sheet feeding tray units 51*a* to 51*c* forming the sheet feeding unit 51, the sheets S (standard sheets, special sheets) identified on the basis of a basis weight, a size, and the like are accommodated for each preset type. The conveyance path unit 53 has a plurality of conveying rollers such as a registration roller pair 53*a*.

The sheets S accommodated in the sheet feeding tray units 51*a* to 51*c* are fed one by one from the top and conveyed to the image former 40 by the conveyance path unit 53. At this time, a registration roller unit disposed with the registration roller pair 53*a* corrects an inclination of the fed sheet S and adjusts conveyance timing. Then, the toner image of the intermediate transfer belt 421 is secondarily transferred collectively on one side of the sheet S in the image former 40, and a fixing process is performed in the fixing unit 60. The sheet S formed with an image is discharged outside the apparatus by the sheet discharging unit 52 provided with a sheet discharge roller 52*a*.

Figure 3:
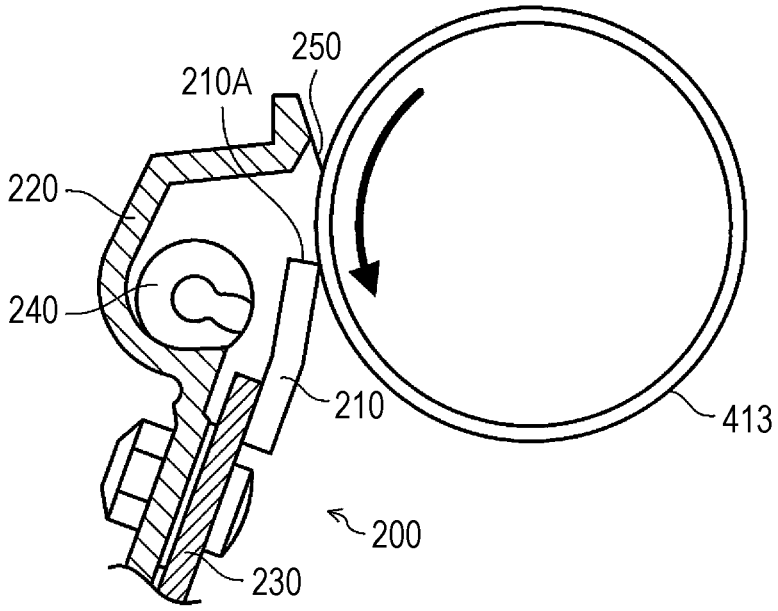
FIG. 3 is an enlarged view of a drum cleaning device.

Next, details of the drum cleaning device 200 will be described. FIG. 3 is an enlarged view of the drum cleaning device 200.

As shown in FIG. 3, the drum cleaning device 200 includes the drum cleaning blade 210, a waste toner storage unit 220, a holding sheet metal 230, a conveyance member 240, and a seal member 250.

The drum cleaning blade 210 is made of, for example, an elastic body such as urethane rubber having excellent wear resistance and ozone resistance, and is formed in a plate shape extending in a direction against a rotation direction of the photosensitive drum 413 (upper left direction in FIG. 3).

An end of the tip end surface 210A of the drum cleaning blade 210 is in contact with the surface of the photosensitive drum 413. By the photosensitive drum 413 moving relative to a contact part with the drum cleaning blade 210, the drum cleaning blade 210 scrapes off and cleans the toner adhering to the surface of the photosensitive drum 413.

A thickness of the drum cleaning blade 210 is set to, for example, 0.5 to 2.0 mm, and a length of the drum cleaning blade 210 is set to, for example, 5 to 12 mm. Note that the thickness and the length of the drum cleaning blade 210 may be appropriately changed in accordance with a specification of the apparatus and a method of manufacturing the elastic body. Details of the drum cleaning blade 210 will be described later.

The waste toner storage unit 220 is a housing to accommodate the toner scraped off from the photosensitive drum 413 by the drum cleaning blade 210. The waste toner storage unit 220 has an opening, and is disposed facing the photosensitive drum 413 such that the opening is positioned upstream of the contact part between the drum cleaning blade 210 and the photosensitive drum 413, in the rotation direction of the photosensitive drum 413.

The holding sheet metal 230 is a sheet metal that holds the drum cleaning blade 210, and is fixed to the waste toner storage unit 220. The holding sheet metal 230 is made of a steel plate such as SECC, suppresses deformation of the drum cleaning blade 210, and has a thickness set to a level that satisfies a specification of edge straightness (for example, 1.6 to 2.0 mm).

The drum cleaning blade 210 is attached to the holding sheet metal 230 by, for example, a thermoplastic hot melt adhesive, a double-sided tape, or the like. Note that, when the drum cleaning blade 210 is molded, the drum cleaning blade 210 may be attached to the holding sheet metal 230 by integral molding using a metal mold.

The conveyance member 240 is disposed in the waste toner storage unit 220, and conveys waste toner in the waste toner storage unit 220 toward a waste toner collecting unit (not shown).

The seal member 250 is a member that fills a gap between the opening of the waste toner storage unit 220 and the photosensitive drum 413, and is disposed at an edge opposite to the drum cleaning blade 210 in the opening.

Further, an external additive (for example, silica) is added to the toner used in the present embodiment. The external additive is a sphere that is significantly smaller than the toner. The external additive is separated from the toner as the toner collides with one another in the convection of the toner near the contact part between the drum cleaning blade 210 and the photosensitive drum 413. Since the external additive separated from the toner has a diameter smaller than that of the toner, the external additive moves to the contact part and accumulates in the contact part, and hence enters between the drum cleaning blade 210 and the photosensitive drum 413.

This causes the external additive to serve as a roller to suppress direct contact between the drum cleaning blade 210 and the photosensitive drum 413. When the drum cleaning blade 210 is contacted to clean the photosensitive drum 413, the contact part of the drum cleaning blade 210 is to be worn due to the contact with the rotating photosensitive drum 413. This deteriorates the cleaning function of the drum cleaning blade 210, and hence causes a cleaning failure.

However, in the present embodiment, the external additive entering between the drum cleaning blade 210 and the photosensitive drum 413 makes it possible to suppress wear of the drum cleaning blade 210.

Figure 4:
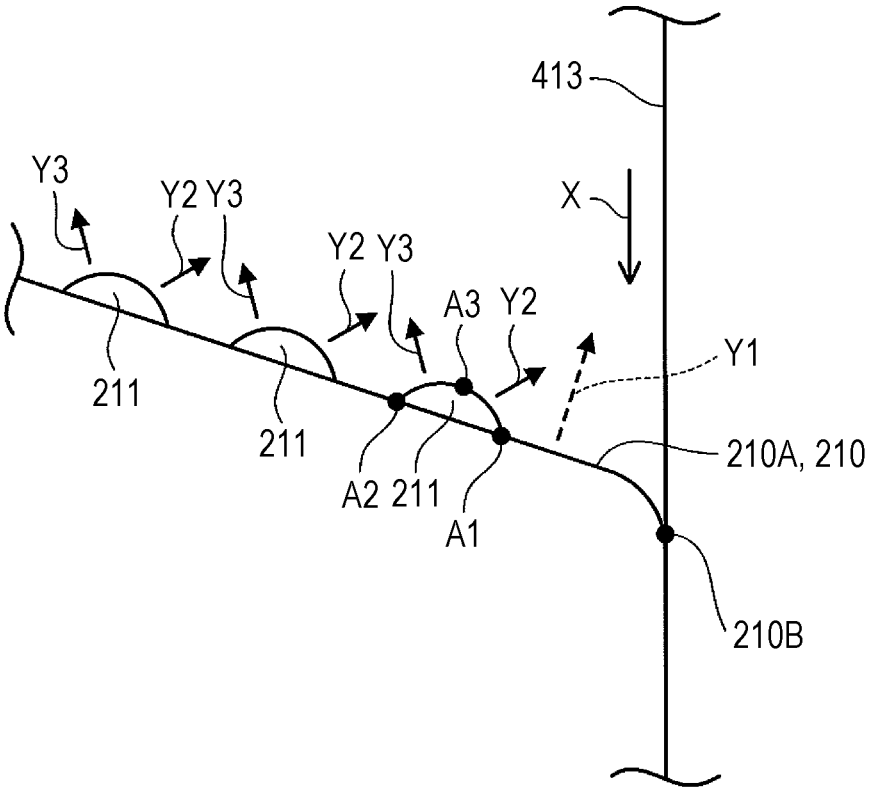
FIG. 4 is an enlarged view of a tip end surface part of a drum cleaning blade.

Next, details of the drum cleaning blade 210 will be described. FIG. 4 is an enlarged view of the tip end surface 210A part of the drum cleaning blade 210.

Figure 5:
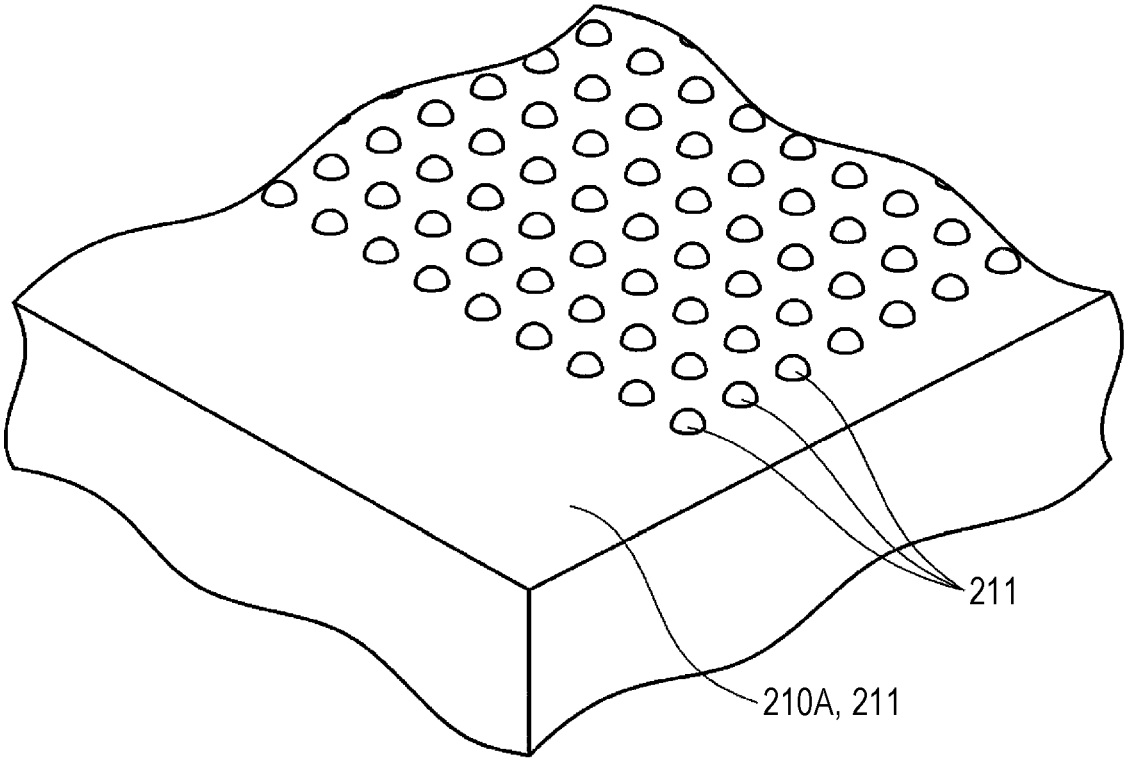
FIG. 5 is a perspective view of the tip end surface of the drum cleaning blade.

As shown in FIGS. 4 and 5, a plurality of protrusions 211 are formed on the tip end surface 210A of the drum cleaning blade 210. The tip end surface 210A of the drum cleaning blade 210 is a surface extending from a contact part 210B between the drum cleaning blade 210 and the photosensitive drum 413, and facing the side where the toner is cleaned on the photosensitive drum 413. The tip end surface 210A of the drum cleaning blade 210 corresponds to the "cleaning surface" in the present invention, with respect to the contact part 210B.

Note that the side where the toner is cleaned on the photosensitive drum 413 is upstream of the contact part 210B in a moving direction of the photosensitive drum 413 that moves relative to the contact part 210B.

The individual protrusions 211 are arranged in array in a first direction and a second direction of the drum cleaning blade 210. The first direction is, for example, a direction parallel to the tip end surface 210A and orthogonal to an axial direction of the photosensitive drum 413 (upper left direction in FIG. 4, upper right direction in FIG. 5). The second direction is, for example, a direction parallel to the tip end surface 210A and the same direction as the axial direction of the photosensitive drum 413 (upper left direction in FIG. 5). Note that, the first direction and the second direction are orthogonal to each other in the present embodiment, but may not be orthogonal to each other.

Each protrusion 211 is formed in a hemispherical shape having an apex A3 between a first end A1 closest to the contact part 210B side and a second end A2 farthest from the contact part 210B side.

The plurality of protrusions 211 are formed at positions away by a predetermined distance from the contact part 210B with the photosensitive drum 413, on the drum cleaning blade 210. The predetermined distance is, for example, 20 μm or more.

The tip end surface 210A of the drum cleaning blade 210 is inclined toward upstream in the moving direction of the photosensitive drum 413 (the same direction as arrow X, which is a moving direction of the toner), with respect to the contact part 210B, which is the part where the toner adhering to the photosensitive drum 413 is to be scraped off. That is, the tip end surface 210A is located upstream of the contact part 210B in the movement direction.

Therefore, the tip end surface 210A is arranged so as to repel the toner in the direction toward the photosensitive drum 413 (see arrow Y1) when the toner scraped off by the contact part 210B collides with the tip end surface 210A. Arrow Y1 is a perpendicular direction of the tip end surface 210A in FIG. 4, but may be slightly offset with respect to the perpendicular direction.

The direction in which the tip end surface 210A repels the toner is toward the moving direction (arrow X) of the toner on the photosensitive drum 413. Therefore, the toner repelled by the tip end surface 210A collides with the toner on the photosensitive drum 413.

Figure 6:
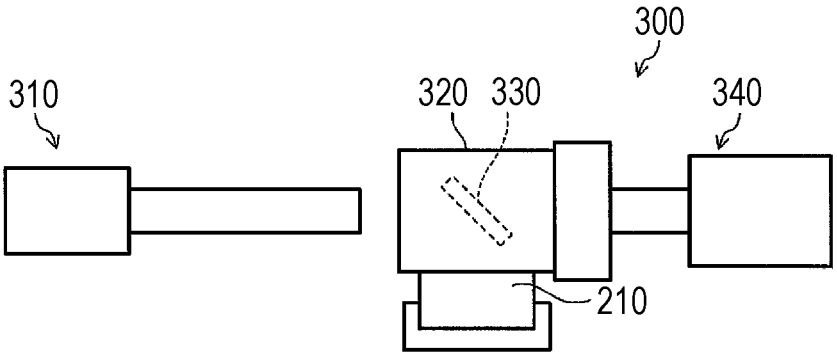
FIG. 6 is a view schematically showing a toner behavior monitoring device.

When the frequency of the toner collision near the tip end surface 210A increases, the toner aggregates easily on the tip end surface 210A. FIG. 6 is a view schematically showing a toner behavior monitoring device.

Here, a state of toner aggregation on the tip end surface 210A will be described with use of a toner behavior monitoring device 300 shown in FIG. 6. As shown in FIG. 6, the toner behavior monitoring device 300 includes an imaging unit 310, a glass tube 320, a reflecting mirror 330, and a drive source 340.

The imaging unit 310 is a high speed camera having a high magnification lens. The glass tube 320 is formed in a tubular shape. The tip end surface 210A of the drum cleaning blade 210 is in contact with a surface of the glass tube 320.

The reflecting mirror 330 is disposed inside the glass tube 320, and disposed so as to be capable of displaying the contact part between the drum cleaning blade 210 and the glass tube 320, to the imaging unit 310.

The drive source 340 is a motor that rotatably supports the glass tube 320. By driving the drive source 340, the glass tube 320 is rotated. In this toner behavior monitoring device 300, the glass tube 320 serves as the photosensitive drum 413. By imaging the contact part between the rotating glass tube 320 and the drum cleaning blade 210 with the imaging unit 310, it becomes possible to monitor a behavior of toner at the contact part.

Meanwhile, on upstream of the contact part with the drum cleaning blade 210 in the rotational direction of the glass tube 320, a developing device (not shown) that supplies toner to the glass tube 320 is disposed.

Figure 7:
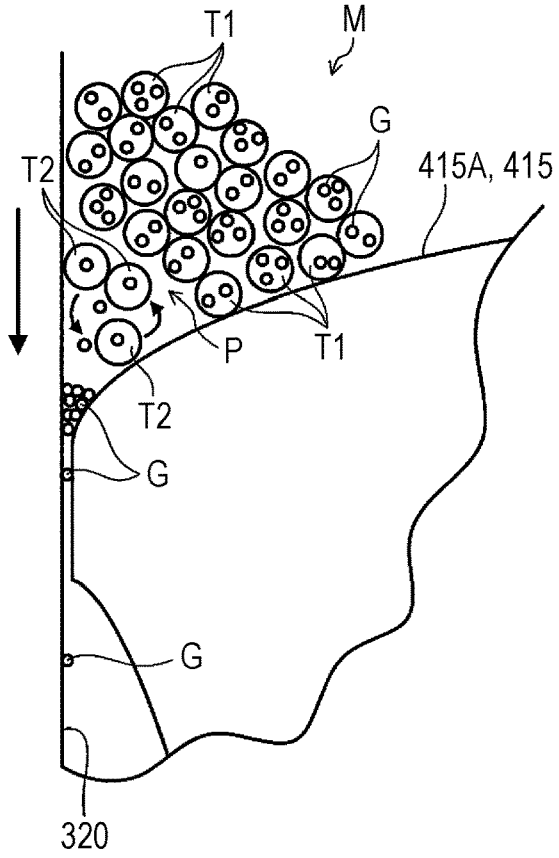
FIG. 7 is an enlarged view of a contact part between a blade having no protrusion and a glass tube.
Figure 8:
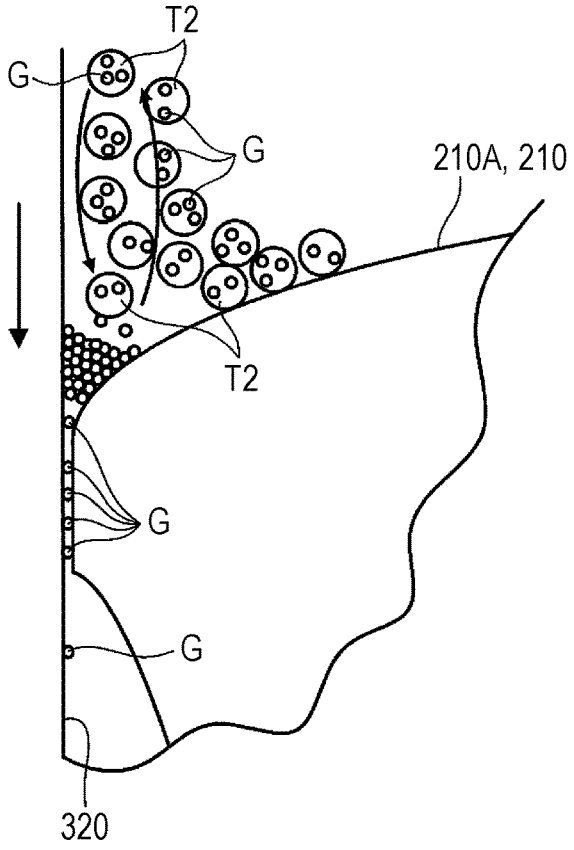
FIG. 8 is an enlarged view of a contact part between a drum cleaning blade having a protrusion and the glass tube.

A behavior of toner when the drum cleaning blade 210 is replaced with a blade 415 having no protrusion 211 as shown in FIG. 7 will be described. A moving direction of the glass tube 320 in FIGS. 7 and 8 is a direction from the top to the bottom.

In a case of the blade 415, toner reaching the contact part is repelled toward the glass tube 320 on an entire tip end surface 415A. Therefore, such toner collides with toner moving along with movement of the photosensitive drum 413, to aggregate. This causes formation of a toner aggregation part M made of aggregated toner T1, on the tip end surface 415A.

When the toner aggregation part M is formed, a space P surrounded by the blade 415, the glass tube 320, and the toner aggregation part M is formed. The space P becomes smaller as the toner aggregation part M becomes larger. Therefore, a convective range of convective toner T2 in the space P, that is, near the contact part between the blade 415 and the glass tube 320 is limited by the decrease of the space P.

In such a state, when an amount of the convective toner T2 decreases, such as when the toner does not move on the glass tube 320, the collision between toner T2 is weakened in the convection, and hence it becomes difficult for an external additive G to be separated from the toner T2. As a result, an amount of the external additive G entering between the blade 415 and the glass tube 320 decreases, causing wear of the blade 415 to be likely to occur.

However, in the present embodiment, the protrusion 211 is formed on the tip end surface 210A of the drum cleaning blade 210. Due to the presence of the protrusion 211, as shown in FIG. 4, the toner moving toward the tip end surface 210A collides with the protrusion 211 and bounces back. The protrusion 211 is formed in a hemispherical shape, and an upper half surface in FIG. 4 (surface in a range between the first end A1 and the apex A3) faces the photosensitive drum 413 side with respect to a perpendicular direction (arrow Y1) of the tip end surface 210A. Therefore, toner is repelled toward the photosensitive drum 413 on the upper half surface (see arrow Y2).

However, a lower half surface (surface in a range between the apex A3 and the second end A2) faces a side opposite to the photosensitive drum 413 with respect to the perpendicular direction of the tip end surface 210A. Therefore, on the lower half surface, the toner is repelled toward a side away from the photosensitive drum 413 side (see arrow Y3).

This makes it possible to carry the toner to a position farther from the contact part 210B than when the toner is repelled directly toward the photosensitive drum 413. As a result, since it is possible to reduce the toner colliding with toner on the photosensitive drum 413 near the contact part 210B, the amount of toner aggregated on the tip end surface 210A can be reduced.

When an action of the drum cleaning blade 210 is examined by the toner behavior monitoring device 300 shown in FIG. 6, as shown in FIG. 8, the toner aggregation part M as shown in FIG. 7 is not formed, and the convection range of the toner T2 is not limited near the contact part. This enables the convection range of the toner T2 to be maintained, making it easy for the external additive G to be separated from the toner T2 due to the collision between the toner T2 in the convection. Note that illustration of the protrusion 211 is omitted in FIG. 8.

As a result, the amount of the external additive G entering between the drum cleaning blade 210 and the glass tube 320 (photosensitive drum 413) increases, making it possible to suppress wear of the drum cleaning blade 210.

Further, the protrusion 211 is integrally formed by the same material as the drum cleaning blade 210 (for example, urethane rubber). As a method of forming the protrusion 211, for example, an inkjet method can be applied. This enables formation of a desired number of the protrusions 211 by discharging the material by a necessary amount to any position of the tip end surface 210A.

Further, it is also possible to change impact resilience of each protrusion 211 by changing a formula of the material to be discharged, in accordance with a position of the protrusion 211 of the tip end surface 210A. The impact resilience is, for example, an impact resilience coefficient or the like. Therefore, the impact resilience of the protrusion 211 may be made larger than impact resilience of a part other than the protrusion 211 of the drum cleaning blade 210.

This can increase a repulsive force of the toner that collides with the protrusion 211 to be repelled more than a part other than the protrusion 211, enabling an amount of the repelled toner to be increased. This increases the convection range of the toner, making it easy for the external additive to be separated from the toner due to collision between toner in the convection, and hence making it possible to suppress wear of the drum cleaning blade 210.

Further, the plurality of protrusions 211 may be arranged such that higher impact resilience is provided to the protrusion 211 located at a position further away from the contact part 210B with the photosensitive drum 413, in the drum cleaning blade 210. That is, impact resilience of a predetermined protrusion 211 among the plurality of protrusions 211 may be higher than impact resilience of the protrusion 211 at a position closer to the contact part 210B than the predetermined protrusion 211.

When a difference between physical properties of the protrusion 211 close to the contact part 210B and physical properties of a part other than the protrusion 211 is too large, a crack of the drum cleaning blade 210 is easily generated. However, by making the impact resilience higher for the protrusion 211 further away from the contact part 210B in this way, it is possible to increase the repulsive force of toner at the protrusion 211 that is away from the contact part 210B, while reducing the difference between the physical properties of the protrusion 211 close to the contact part 210B and the physical properties of apart other than the protrusion 211. As a result, it is possible to increase the repulsive force of the toner at the protrusion 211 while suppressing generation of a crack of the drum cleaning blade 210.

Meanwhile, the protrusion 211 may be formed by a mold or the like in consideration of cost reduction.

Figure 9:
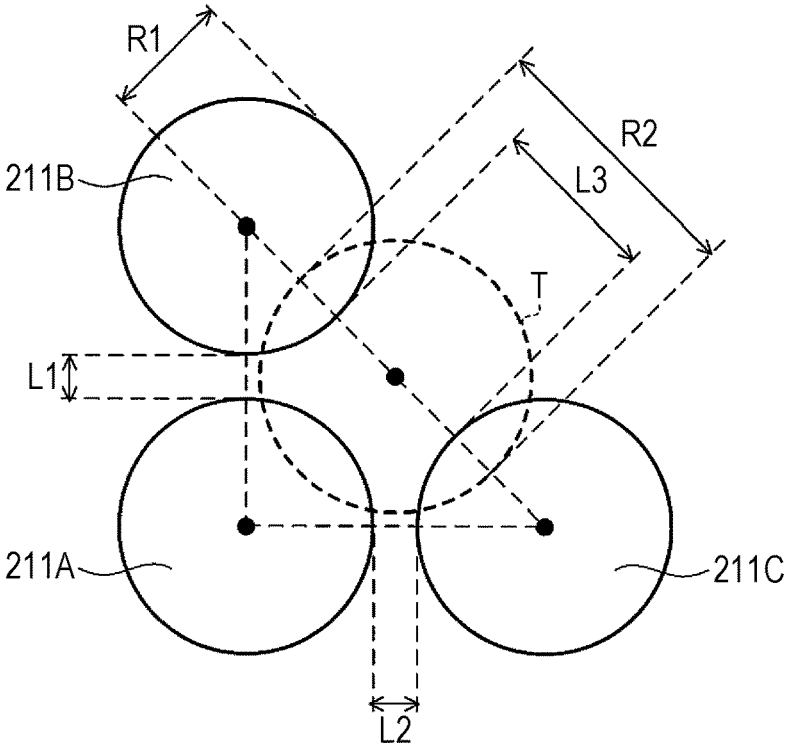
FIG. 9 is a view for explaining a distance between individual protrusions.

Further, a distance between the protrusions 211 is desirably a distance of such a degree to inhibit entering of toner. Specifically, as shown in FIG. 9, among the plurality of protrusions 211, a protrusion distance between two protrusions 211 adjacent in a predetermined direction is shorter than a radius of the toner. The protrusion distance is a value obtained by subtracting a radius R1 of each protrusion 211 from a distance between the centers of the protrusions 211. Meanwhile, in FIG. 9, all the radiuses R1 of the individual protrusions 211 have a same length.

Specifically, a protrusion distance L1 between a first protrusion 211A and a second protrusion 211B adjacent to the first protrusion 211A in the first direction (up-down direction in FIG. 9) is shorter than a radius of the toner T. Further, a protrusion distance L2 between the first protrusion 211A and a third protrusion 211C adjacent to the first protrusion 211A in the second direction (left-right direction in FIG. 9) is shorter than the radius of the toner T.

Then, a protrusion distance L3 between the second protrusion 211B and the third protrusion 211C is shorter than a diameter R2 of the toner T. This inhibits entering of the toiler T into between the protrusions 211, in a case of a configuration in which the protrusions 211 are arranged at equal intervals in each of the first direction and the second direction. Accordingly, since the toner T can be reliably made to collide with the protrusion 211, the convection range of the toner T can be expanded.

Further, since the toner T is unable to enter between the protrusions 211, the toner T is not clogged between the protrusions 211. As a result, the repulsive force at the protrusion 211 can be maintained for a long time.

Meanwhile, as long as the protrusion distance L3 is shorter than the diameter R2 of the toner T, the protrusion distance of the two protrusions 211 adjacent in one of the first direction and the second direction may not be shorter than the radius of the toner T.

According to the present embodiment configured as described above, the toner cleaned at the contact part 210B collides with the protrusion 211 provided on the drum cleaning blade 210, which causes the toner to be repelled toward a side opposite to the photosensitive drum 413 with respect to the perpendicular direction. This can suppress formation of a toner aggregation part on the tip end surface 210A of the drum cleaning blade 210, and widen the convection range of the toner, enabling the external additive to be effectively separated from the toner. As a result, it is possible to increase the amount of the external additive entering between the drum cleaning blade 210 and the photosensitive drum 413, making it possible to suppress wear of the drum cleaning blade 210.

Further, the life of the drum cleaning blade 210 can be extended by suppressing wear of the drum cleaning blade 210, enabling reduction of downtime of the image forming apparatus 1 due to parts maintenance.

Meanwhile, a configuration is known in which a recess is provided on a tip end surface of a drum cleaning blade. However, when there is a recess, there is a risk of stress concentration at the bottom of the recess due to a frictional force caused between the drum cleaning blade and a photosensitive drum. In a part where stress is concentrated, a crack occurs. This leads to chipping in the drum cleaning blade, causing a problem that a cleaning failure occurs.

However, in the present embodiment, since the protrusion 211 is formed on the tip end surface 210A of the drum cleaning blade 210, the above problem does not occur. That is, in the present embodiment, since the life of the drum cleaning blade 210 can be extended, the occurrence of a cleaning failure can be suppressed.

Further, when the tip end surface 210A of the drum cleaning blade 210 is arranged so as not to face the photosensitive drum 413, the perpendicular of the tip end surface 210A does not intersect with the photosensitive drum 413. Therefore, in some cases, the toner may be repelled in a direction different from that of the photosensitive drum 413. However, even with this configuration, a drawn amount of the drum cleaning blade 210 into the photosensitive drum 413 fluctuates depending on environmental conditions and image forming conditions. Therefore, the tip end surface 210A may still be tilted so as to repel the toner toward the photosensitive drum 413.

However, in the present embodiment, the protrusion 211 having a surface facing various directions is formed on the tip end surface 210A. Therefore, even if environmental conditions, image forming conditions, and the like vary and the drawn amount of the drum cleaning blade 210 fluctuates, the amount of toner repelled by the protrusion 211 toward the photosensitive drum 413 can be reduced.

Meanwhile, when a location of the contact part 210B between the drum cleaning blade 210 and the photosensitive drum 413 is made in an uneven shape, there is a possibility that pressure irregularities occur at the location, which may cause a cleaning failure.

However, in the present embodiment, since the protrusion 211 is formed at a position away by a predetermined distance from the contact part 210B on the tip end surface 210A, occurrence of the above pressure irregularities can be suppressed. As a result, it is possible to suppress occurrence of a cleaning failure caused by pressure irregularities.

Figure 10:
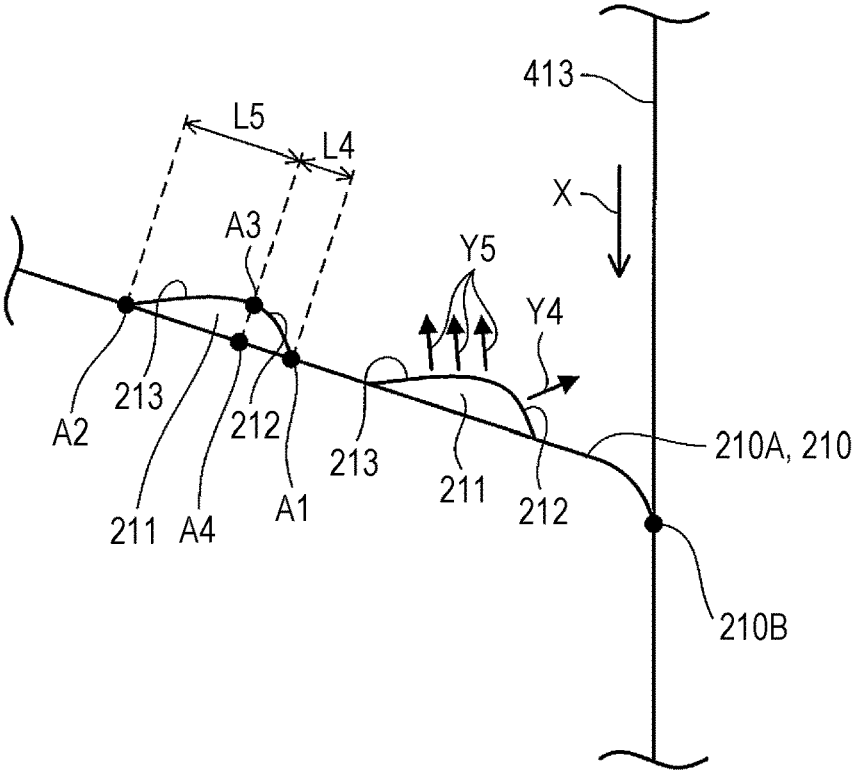
FIG. 10 is an enlarged view of a contact part between a drum cleaning blade and a photosensitive drum according to a first modification.

Although the protrusion 211 is formed in a hemispherical shape in the above embodiment, the present invention is not limited to this. For example, the protrusion 211 may not be formed in a hemispherical shape, but may be formed in a conical shape, a polygonal pyramid shape, or the like. For example, as shown in FIG. 10, a first distance L4 from the first end A1 of the protrusion 211 to an apex position A4 corresponding to the apex A3 of the protrusion 211 on the tip end surface 210A may be formed to be smaller than a second distance L5 from the apex position A4 to the second end A2.

By forming the protrusion 211 in this way, an area of a first surface 212 facing the photosensitive drum 413 side in the protrusion 211 can be made smaller than an area of a second surface 213 facing away from the photosensitive drum 413. The toner is repelled toward the photosensitive drum 413 (see arrow Y4) in the first surface 212, while the toner is repelled toward a side opposite to the photosensitive drum 413 (see arrow Y5) in the second surface 213.

Therefore, by making the area of the first surface 212 smaller than the area of the second surface 213, it is possible to increase a proportion of the toner to be repelled by the second surface 213. This can increase the convection range of the toner near the contact part 210B, and hence suppress wear of the drum cleaning blade 210.

Moreover, in the above embodiment, although the protrusion 211 is formed in a hemispherical shape, that is, in a circular shape, the present invention is not limited to this. For example, as shown in FIG. 11, the protrusion 211 may be formed to be tapered as being separated from the contact part 210B on the tip end surface 210A.

Figure 11:
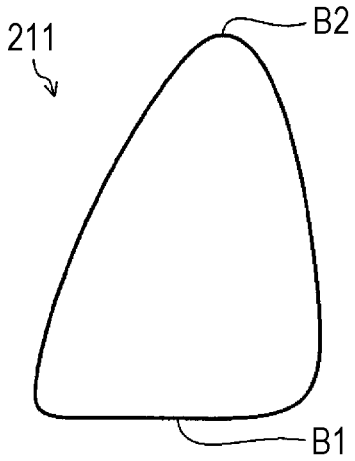
FIG. 11 is an enlarged view of a protrusion according to a second modification.

In the example shown in FIG. 11, the protrusion 211 is formed in a triangular shape having a bottom side B1 on the contact part 210B side and having an apex B2 on a side opposite to the contact part 210B. In addition, a part of the bottom side B1 may have an are shape.

This make it easy to cause the toner on the tip end surface 210A to move to a side away from the contact part, from the viewpoint of facilitating a flow of fluid toward the tapered side, it is possible to suppress formation of a toner aggregation part near the contact part. As a result, the convection range of the toner is suppressed from being narrowed and limited. This configuration is particularly favorable in a case where flowability of the toner is deteriorated, such as when environmental conditions around the image forming apparatus 1 are high temperature and high humidity.

Figure 12:
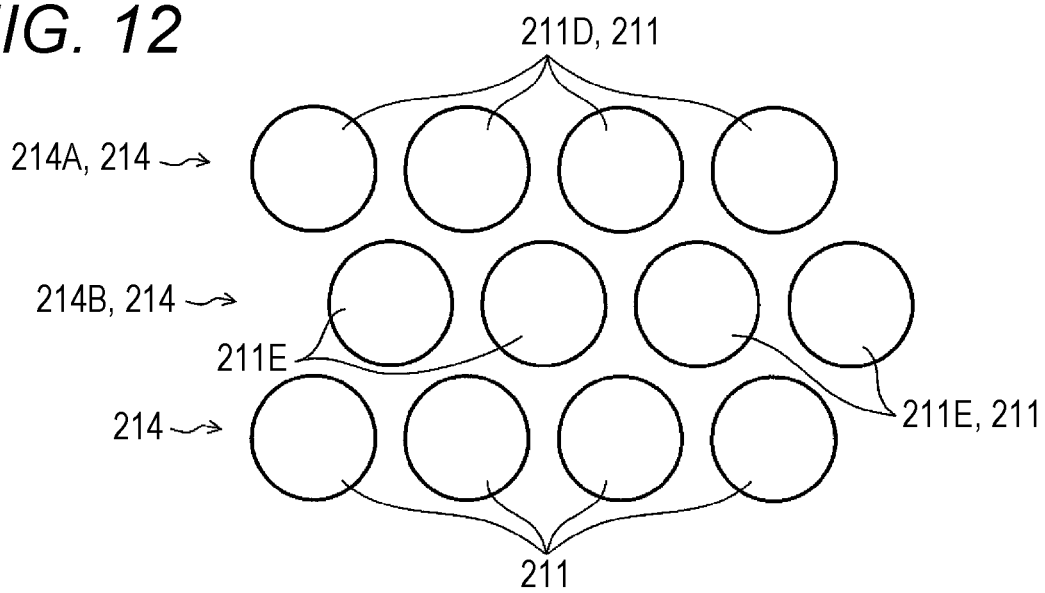
FIG. 12 is a view showing another example of arrangement of a plurality of protrusions.

Furthermore, in the above embodiment, a plurality of protrusions 211 are arranged at equal intervals in each of the first direction and the second direction, but the present invention is not limited to this. For example, as shown in FIG. 12, the drum cleaning blade 210 may have a plurality of protrusion rows 214 arranged in a fourth direction (up-down direction in FIG. 12) and each formed by a plurality of protrusions 211 arranged in a third direction (left-right direction in FIG. 12).

The third direction and the fourth direction are directions parallel to the tip end surface 210A and orthogonal to each other. Note that, in FIG. 12, the third direction is the left-right direction (second direction), and the fourth direction is the up-down direction (first direction). However, the third direction may be the up-down direction and the fourth direction may be the left-right direction.

In addition, each protrusion 211D of a first protrusion row 214A may be disposed at a shifted position in the third direction from each protrusion 211E of a second protrusion row 214B adjacent in the fourth direction.

This can make it easy to narrow the interval between the protrusions 211, enabling the toner to be unlikely to enter between the protrusions 211. As a result, the toner can easily collide with the protrusion 211.

Figure 13:
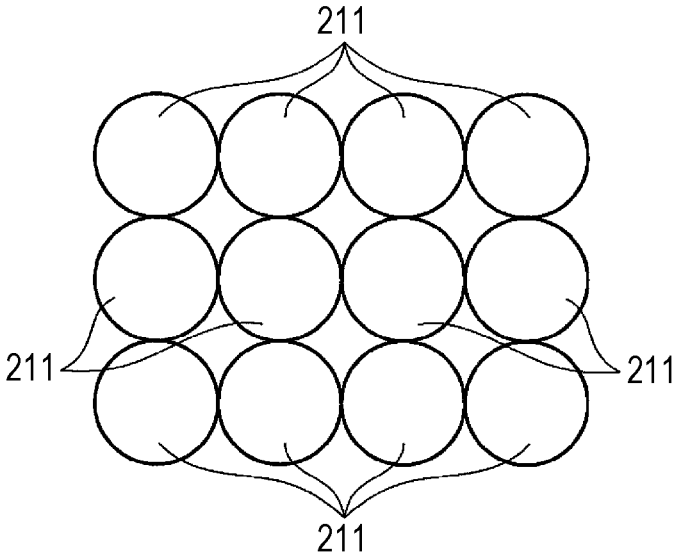
FIG. 13 is a view showing another example of arrangement of a plurality of protrusions.

Further, as shown in FIG. 13, two adjacent protrusions 211 may be formed to be in contact with each other. This can minimize a distance between the protrusions 211, allowing the toner to easily collide with the protrusions 211.

Further, in the above embodiment, the plurality of protrusions 211 are formed on the tip end surface 210A of the drum cleaning blade 210. However, the present invention is not limited to this, and the plurality of protrusions 211 may be one protrusion formed over the entire axial direction of the photosensitive drum 413.

Further, in the above embodiment, the protrusion 211 is formed at a position away by a predetermined distance from the contact part 210B on the tip end surface 210A. However, the present invention is not limited to this, and the protrusion 211 is not necessarily away by a predetermined distance. However, when the protrusion 211 is not to be away from the contact part 210B by a predetermined distance, it is desirable to separately take measures and the like against pressure irregularities, since there is a possibility that a cleaning failure due to pressure irregularities occurs.

Further, in the above embodiment, the photosensitive drum 413 is exemplified as the member to be cleaned. However, the present invention is not limited to this, and the member to be cleaned may be, for example, the intermediate transfer belt 421. In this case, the cleaning member is to be a cleaning blade in the belt cleaning device 426.

Further, in the above embodiment, the tip end surface 210A is exemplified as the cleaning surface. However, the present invention is not limited to this, and a surface other than the tip end surface 210A may be a cleaning surface.

In addition, each of the above embodiments is merely an example of implementation in carrying out the present invention, and the technical scope of the present invention should not be construed in a limited manner by these. That is, the present invention can be implemented in various forms without departing from the scope or main features of the present invention.

Finally, evaluation experiments of the image forming apparatus 1 according to the present embodiment will be described. First, with use of the image forming apparatus 1 shown in FIG. 1, horizontal band images of a continuous number with a coverage of 5% were printed, and the number of printed sheets in which a cleaning failure occurred was examined. In Example 1, impact resilience of all the protrusions 211 in the drum cleaning blade 210 was constant, while in Example 2, impact resilience was increased as a distance from the contact part increases. In addition, in a comparative example, no protrusion 211 was provided on the drum cleaning blade 210. Table 1 shows the experimental results.

TABLE 1

| Number of printed sheets | Comparative example | Example 1 | Example 2 |
|---|---|---|---|
| 0 kp | ○ | ○ | ○ |
| 50 kp | ○ | ○ | ○ |
| 100 kp | ○ | ○ | ○ |
| 150 kp | x | ○ | ○ |
| 200 kp | — | ○ | ○ |
| 250 kp | — | x | ○ |
| 300 kp | — | — | x |

Note that "○" in Table 1 indicates that an image in which no cleaning failure has occurred has been obtained, and "x" indicates that an image failure based on a cleaning failure has occurred.

First in the comparative example, it was confirmed that a cleaning failure occurred when the number of printed sheets was 150 kp. Whereas, in Example 1, it was confirmed that a cleaning failure occurred when the number of printed sheets was 250 kp. From this result, it can be confirmed that, by forming the protrusion 211 on the drum cleaning blade 210, more printing can be performed without causing a cleaning failure than the configuration without formation of the protrusion 211. That is, in the present embodiment, it can be confirmed that wear of the drum cleaning blade 210 can be suppressed.

Further, in Example 2, it was confirmed that a cleaning failure occurred when the number of printed sheets was 300 kp. From this result, it can be confirmed that even more printing can be performed by changing the impact resilience of the protrusion 211, and hence wear of the drum cleaning blade 210 can be further suppressed.

Next, with use of the image forming apparatus 1 shown in FIG. 1, 50 kp of horizontal band images with a coverage of 1% were printed with environmental conditions around the image forming apparatus 1 of normal temperature and normal humidity conditions (temperature 23° C. humidity 65%) or high temperature and high humidity conditions (temperature 30° C., humidity 85%), and it was examined whether a cleaning failure occurred. Conditions of Example 1 and the comparative example are similar to that in the experiment in Table 1. In addition, in Example 3, a shape of the protrusion 211 was made to be a shape shown in FIG. 11. Table 2 shows the experimental results.

TABLE 2

| Environmental conditions | Comparative example | Example 1 | Example 3 |
|---|---|---|---|
| Normal temperature and normal humidity | ○ | ○ | ○ |
| High temperature and high humidity | x | Δ | ○ |

Note that "○" in Table 2 indicates that an image in which no cleaning failure has occurred has been obtained, "Δ"

indicates that an image with a practically acceptable level has been obtained, and "x" indicates that an image failure based on a cleaning failure has occurred.

First, under the normal temperature and normal humidity conditions, no cleaning failure occurred in all of the comparative example, Example 1, and Example 3. Next, it was confirmed that under the high temperature and high humidity conditions, a cleaning failure occurred in the comparative example. This is because the drum cleaning blade 210 is easily worn under a condition where an amount of toner is small (a condition where the coverage is low) since fluidity of the toner decreases under the high temperature and high humidity conditions.

On the other hand, in Example 1, it was confirmed that an image with a practically acceptable level was obtained. From this result, it can be confirmed that, by forming the protrusion 211 on the drum cleaning blade 210, a cleaning failure is less likely to occur than the configuration without formation of the protrusion 211.

In addition, in Example 3, it was confirmed that an image in which no cleaning failure occurred was obtained. From this result, it can be confirmed that a cleaning failure is less likely to occur than in Example 1. Thereby, it can be confirmed that the shape shown in FIG. 11 makes it easier for the toner to move away from the contact part, and the external additive is easily separated from the toner due to an increase in the convection range of the toner near the contact part even under the condition of less toner amount.

Finally, with use of the image forming apparatus 1 shown in FIG. 1, generation of a cleaning failure due to pressure irregularities and generation of cracks in the drum cleaning blade 210 were examined, in a case of changing the predetermined distance from the contact part of the drum cleaning blade 210 to the protrusion 211. As the printing conditions, the image to be printed is a horizontal band image of 5% coverage, the temperature around the image forming apparatus 1 is 23° C., the humidity around the image forming apparatus 1 is 65%, and the number of printed sheets is 50 kp.

TABLE 3

| | Predetermined distance | | | | | | | |
|---|---|---|---|---|---|---|---|---|
| | 0 μm | 5 μm | 10 μm | 20 μm | 40 μm | 50 μm | 75 μm | 100 μm |
| CL failure | x | Δ | ○ | ○ | ○ | ○ | ○ | ○ |
| Crack | — | — | x | ○ | ○ | ○ | ○ | ○ |

Note that "CL failure" in Table 3 indicates a cleaning failure caused by pressure irregularities, and "Crack" indicates a crack caused by pressure irregularities. In addition, "○" of "CL failure" in Table 3 indicates that an image in which no cleaning failure has occurred has been obtained, "Δ" indicates that an image with a practically acceptable level has been obtained, and "x" indicates that an image failure based on a cleaning failure has occurred. Further, "○" of "Crack" in Table 3 indicates a case where no crack of the drum cleaning blade 210 occurs in microscope observation, and "x" indicates a case where a crack occurs in a root part of the protrusion 211 of the drum cleaning blade 210.

As shown in Table 3, it was confirmed that no cleaning failure occurred when the predetermined distance in the drum cleaning blade 210 was 10 μm or more. In addition, it was confirmed that no crack occurred in the drum cleaning blade 210 when the predetermined distance was 20 μm or more.

From this, it was confirmed that neither a cleaning failure nor a crack of the drum cleaning blade 210 occurred when the predetermined distance was 20 μm or more. That is, in the present embodiment, it can be confirmed that the predetermined distance is desirably to be 20 μm or more.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a cleaning member formed by an elastic body; and a member to be cleaned in which toner added with an external additive adheres to a surface, and the toner is to be cleaned by the cleaning member being in contact with the surface, wherein the cleaning member has a protrusion disposed on a cleaning surface extending from a contact part with the member to be cleaned, and facing a side where the toner is to be cleaned, of the member to be cleaned, wherein the protrusion is formed at a position away by a predetermined distance from the contact part, on the cleaning surface and the predetermined distance is 20 μm or more.

2. The image forming apparatus according to claim 1, wherein the protrusion comprises a surface facing a side opposite to the member to be cleaned with respect to a perpendicular direction of the cleaning surface.

3. The image forming apparatus according to claim 1, wherein impact resilience of the protrusion is higher than impact resilience of a part other than the protrusion of the cleaning surface.

4. The image forming apparatus according to claim 1, wherein the protrusion comprises an apex located between a first end closest to the contact part on the cleaning surface and a second end farthest from the contact part with respect to the first end, and a first distance from the first end to an apex position corresponding to the apex on the cleaning surface is shorter than a second distance from the apex position to the second end.

5. The image forming apparatus according to claim 1, wherein the cleaning member has a plurality of the protrusions disposed on the cleaning surface.

6. The image forming apparatus according to claim 5, wherein among the plurality of the protrusions, impact resilience of a predetermined protrusion is higher than impact resilience of a protrusion at a position closer to the contact part than the predetermined protrusion.

7. The image forming apparatus according to claim 5, wherein the plurality of the protrusions comprise: a first protrusion; a second protrusion adjacent to the first protrusion in a first direction; and a third protrusion adjacent to the first protrusion in a second direction different from the first direction, and a distance between the second protrusion and the third protrusion is shorter than a diameter of the toner.

8. The image forming apparatus according to claim 5, wherein the cleaning member comprises a plurality of protrusion rows each formed by a plurality of protrusions and each row being arranged in a first direction, such that each protrusion in a first row is set at an off-set position along the first direction from each protrusion in a second row of the plurality of protrusion rows.

9. The image forming apparatus according to claim 1, wherein the protrusion is formed to be tapered as being separated from the contact part, on the cleaning surface.

10. The image forming apparatus according to claim 1, wherein the member to be cleaned moves relative to the contact part, and the cleaning surface is located upstream of the contact part in a moving direction of the member to be cleaned.

* * * * *